US005866972A

United States Patent [19]

Matsubara et al.

[11] Patent Number: 5,866,972

[45] Date of Patent: Feb. 2, 1999

[54] SPARK PLUG IN USE FOR AN INTERNAL COMBUSTION ENGINE

[75] Inventors: Yoshihiro Matsubara; Hiroshi Ono, both of Nagoya, Japan

[73] Assignee: NGK Spark Plug Co., Ltd., Aichi, Japan

[21] Appl. No.: 784,516

[22] Filed: Jan. 17, 1997

[30] Foreign Application Priority Data

Jan. 19, 1996 [JP] Japan ..... 8-007168
Jan. 17, 1997 [JP] Japan ..... 9-006197

[51] Int. Cl.[6] ..... H01T 13/20

[52] U.S. Cl. ..... 313/141; 313/142; 313/143

[58] Field of Search ..... 313/141, 142, 313/143, 118, 135; 123/169 EL

[56] References Cited

U.S. PATENT DOCUMENTS

| | | | |
|---|---|---|---|
| 4,122,366 | 10/1978 | Von Stutterheim et al. | 313/141 |
| 4,581,558 | 4/1986 | Takamura et al. | 313/141 |
| 4,845,400 | 7/1989 | Takamura et al. | 313/142 |
| 4,914,344 | 4/1990 | Watanabe et al. | 313/141 |
| 5,124,612 | 6/1992 | Takamura et al. | 313/141 |
| 5,159,232 | 10/1992 | Sato et al. | 313/141 |
| 5,239,225 | 8/1993 | Moriya et al. | 313/141 |
| 5,465,022 | 11/1995 | Katoh et al. | 313/144 |
| 5,557,158 | 9/1996 | Kanao et al. | 313/141 |

FOREIGN PATENT DOCUMENTS

| | | | |
|---|---|---|---|
| 418055 | 3/1991 | European Pat. Off. | H01T 13/39 |
| 0 575 163 | 12/1993 | European Pat. Off. | H01T 13/39 |
| 2 552 947 | 4/1985 | France | H01T 13/20 |
| 839 746 | 4/1952 | Germany . | |
| 2 147 660 | 5/1985 | United Kingdom | H01T 13/39 |

*Primary Examiner*—Frank G. Font
*Assistant Examiner*—Mack Haynes
*Attorney, Agent, or Firm*—Sughrue, Mion, Zinn, Macpeak & Seas, PLLC

[57] ABSTRACT

In a spark plug for use for an internal combustion engine, an elongated insulator is provided in which a center electrode is supported. A cylindrical metal shell is provided in which the insulator is supported, and a ground electrode extends from the metal shell to form a spark gap with a front end of the center electrode. The front end of the center electrode has a tapered-off step section whose front end surface has a spark erosion resistant portion, and having a boundary between a columnar portion of the center electrode and the tapered-off step section. The boundary of the tapered-off step section is located within a front end surface of the insulator, and a front end surface of the tapered-off step section is positioned outside of the front end surface of the insulator. The front end of the center electrode forms a conoidal configuration having an apex angle formed at the center of the center electrode, circumscribing a front periphery of the insulator while maintaining an apex angle of 110 degrees or less.

5 Claims, 7 Drawing Sheets

SPARK PLUG IN USE FOR AN INTERNAL COMBUSTION ENGINE

BACKGROUND OF THE INVENTION

1. Field of the Invention

The invention relates to a spark plug improved so as to effectively prevent flashover from occurring behind a front end surface of an insulator when applying a high voltage across electrodes at the time of ignition.

2. Description of Prior Art

In a spark plug in which spark discharges are induced within an air-fuel mixture gas, an elongated center electrode is placed in a tubular insulator, and a metal shell which supports the insulator, and a front end portion of the center electrode faces a front end of an outer electrode to induce spark discharges across a spark gap provided therebetween.

In this type of the spark plug as represented by FIG. 7, the center electrode has a columnar section 100 on which a semi-frusto-cone shaped step section 101 is provided which is tapered off toward a front end of the center electrode in order to improve an ignitability. On a front end surface of the step section 101, a small columnar portion 102 is provided to reach a front end of the center electrode. It is well-known that the small columnar portion 102 is made of a noble metal material such as a Pt—Ir alloy or the like.

As foreign prior art references relevant to the present invention, U.S. Pat. Nos. 4,914,344 and 4,845,400 are thus far introduced.

However, in the case in which a boundary 103 between the columnar section 100 and the the step section 101 is protracted outside of a front end surface 104 of the insulator as shown in FIG. 7, equi-potential curves concentrate on the front end surface of the insulator so as to likely invite the flashover from the boundary 103 toward a shoulder portion 84 of the insulator as shown at (Fo) in FIG. 7, instead of normally inducing spark discharges across a spark gap between the center electrode and the ground electrode.

This is all the more true for a spark plug which is incorporated into a gas engine which uses gaseous fuel such as natural gas, synthetic gas, LPG or the like. Because this type of the spark plug employs a shorter leg portion of the insulator with a high compression ratio so that a high spark voltage is required to likely invite the flashover.

In the prior art reference of U.S. Pat. No. 4,914,344, a boundary positions inside a front end surface of an insulator 3. However, the structure is such as to induce capacitor discharges between a forward end 41 of third electrode 4 and a front end of the center electrode 1 by way of an auxiliary gap S2, thus likely to invite the flashover behind a front end surface of the insulator.

In the prior art reference of U.S. Pat. No. 4,845,400, a boundary and a taper portion 31 itself are located inside a front end surface of the insulator 2. This provides a wide space between the taper portion 31 and a front inner wall of the insulator 2. The structure is such that a greater amount of heat is retain within the wide space, thus quickly deteriorating a front end of a center electrode.

Therefore, it is a main object of the invention to provide a spark plug which is capable of positively preventing the flashover from occurring behind the front end surface of the insulator, thereby normally inducing spark discharges in the air-fuel mixture gas within a wide range of operating conditions.

SUMMARY OF THE INVENTION

According to the present invnetion, there is provided a spark plug comprising an elongated center electrode having a columnar portion supported within an insulator, and having a boundary between a tapered-off step section and a columnar portion of the center electrode. The boundary of the tapered-off step section is located into a front end surface of the insulator, and a front end surface of the tapered-off step section is positioned outside of the front end surface of the insulator.

The structure is such that a longer stroke length is presented to induce the flashover, thus needing a higher voltage to invite the flashover so as to render it difficult to exhibit the flashover.

Namely, this makes it possible to always maintain a potential voltage between the boundary of the tapered-off step section and a stepped portion of the insulator higher than a potential voltage across a spark gap. This leads to always normally inducing spark discharges across the electrodes without inviting unfavorable flashover behind the front end surface of the insulator when a high voltage is applied across the electrodes at time of ignition.

According to another aspect of the invention, the front end surface of the tapered-off step section is located outside the front end surface of the insulator. This makes it possible to reduce an annular space between a front inner wall of the insulator and an outer surface of the tapered-off step section. With the reduced annular space, it is possible to favorably transmit heat from a front end of the insulator to the tapered-off step section, thus preventing the insulator from excessively heated.

According to still another aspect of the present invention, a front end of the center electrode forms an imaginary conoidal configuration which positions axially with the center electrode, and inscribes the front end surface of the insulator while maintaining an apex angle of the conoidal configuration to be 110 degrees or less.

The advantages derived from the structure are as follows:

In order to avoid the flashover, it is necessary to reduce the voltage required to induce the spark discharges across the electrodes.

As a means of solving this problem, it is found that it is effective to decrease the apex angle of the conoidal configuration so as to decrease the diametrical dimension of the front end surface of the insulator. This leads to always exhibiting the normal spark discharges across the electrodes with a relatively small voltage without inviting the flashover when a high voltage is applied across the electrodes at the time of ignition.

According to other aspect of the present invention, the noble metal tip is made of Pt, Ir, Pt-based alloy, Ir-based alloy or an oxide of these metals containing $Y_2O_3$ or the like as an spark erosion resistant portion. The noble metal tip is provided on the front end of the center electrode. With the noble metal tip represented by these metals and alloys, it is possible to avoid an excessive amount of spark erosion so as to contribute to an extended period of service life.

DETAILED DESCRIPTION OF PREFERRED EMBODIMENTS OF THE INVENTION

Figure 1:
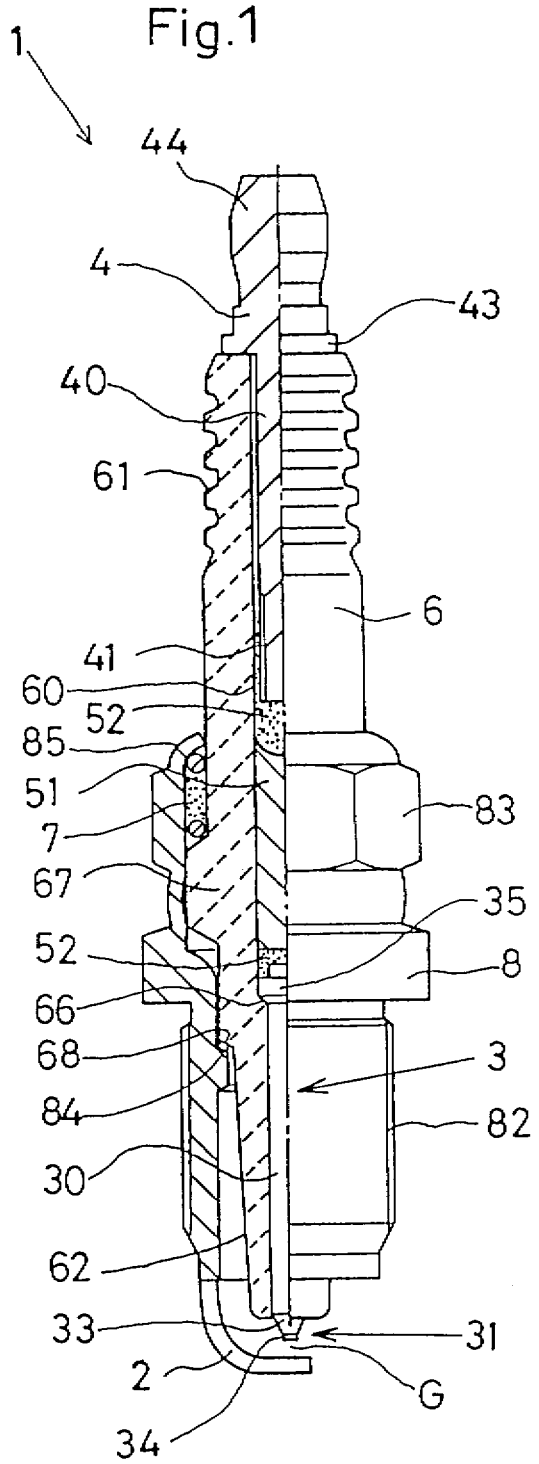
FIG. 1 is a plan view of a spark plug according to a first embodiment of the invention, but its left half portion is longitudinally sectioned.
Figure 2:
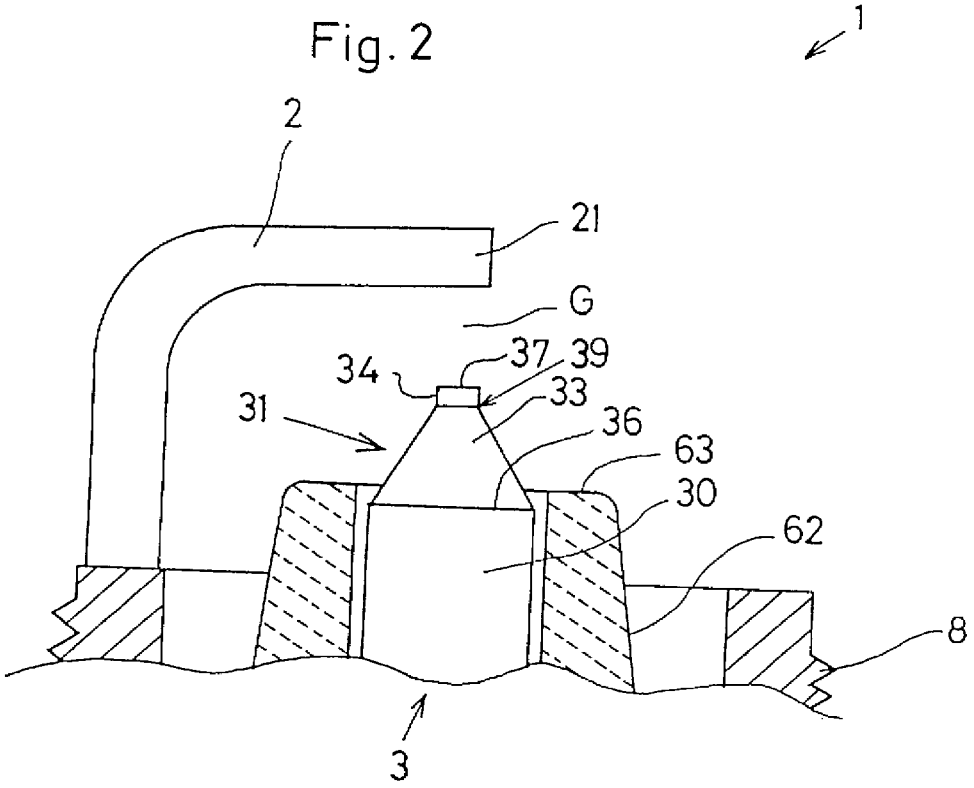
FIG. 2 is an enlarged longitudinal cross sectional view of a firing portion of the spark plug of FIG. 1.

Referring to FIGS. 1 and 2 which show a parallel-electrode type spark plug according to a first embodiment of the present invention, the spark plug is to be mounted on each of cylinders of an internal combustion engine.

The spark plug 1 has a center electrode 3 electrically connected to a secondary coil of an ignition coil, and placed in a combustion chamber (not shown) of the internal combustion engine. The spark plug 1 further has a tubular insulator 6 which supports the center electrode 3 therein, and a metal shell 8 which is secured to a cylinder head (not shown) so as to firmly support the insulator 6.

The metal shell 8 is a steel housing, to a front end of which an ground electrode 2 is connected by means of an electric resistance welding or the like. A front end of the center electrode 3 is in registration with a front end of the ground electrode 2 to form a spark gap (G) therebetween. An outer surface of the metal shell 8 has a male thread portion 82 and a hexagonal nut portion 83 to secure the male thread portion 82 to the cylinder head by working a wrench tool with the hexagonal nut portion 83.

The center electrode 3 is located within an axial bore 60 of the insulator 6 with the front end of the center electrode 3 reaching the combustion chamber. A terminal electrode 4 is provided on a rear end of the center electrode 3 within the axial bore 60. Between the center electrode 3 and the terminal electrode 4, a monolithic resistor powder 51 is encapsulated into the axial bore 60 in a manner to be sandwiched by an electrically conductive glass sealant 52, 52. The insulator 6 is air-tightly connected to the metal shell 8 by means of a talc powder 7.

The center electrode 3 has an electrode metal which is made of a heat resistant and spark erosion resistant nickel alloy, and further having a heat-conductive core embedded in the electrode metal. The center electrode 3 is made by integrally cold extruding the electrode metal and the heat-conductive core. The center electrode 3 has a columnar portion 30 placed within the axial bore 60 of the insulator 6, and a diametrically enlarged flange 35 continuously connected to a rear end of the columnar portion 30 so as to engage with a seat portion 66 protruded from an inner wall of the axial bore 60.

A front section 31 of the center electrode 3 has a tapered-off step section 33 substantially formed into a frusto-cone shaped configuration, and integrally connected to a front end surface of the columnar portion 30. On a front end surface 39 of the step section 33, a noble metal tip 34 is provided as a discal spark erosion resistant portion which is diametrically same as a front end surface 39 of the tapered-off step section 33. The noble metal tip 34 is made of Pt, Ir, Pt-based alloy, Ir-based alloy or an oxide of these metals containing an oxide such as $Y_2O_3$ or the like. The noble metal tip 34 is secured to the front end surface 39 of the tapered-off step section 33 by means of laser beam welding, electrical resistance welding or the like. Instead of using the noble metal tip 34 represented by these metals and alloys, a high chrominum tip which is superior in spark erosion resistant property, or otherewise a chrominum-based alloy may be used in which ceramic powder is dispersed in a chrominum metal. With the use of these materials, it is possible to effectively alleviate the spark erosion so as to contribute to an extended period of service life.

Additionally, with the tapered-off step portion 33 provided on the columnar portion 30, it is possible to insure a large amount of volume of the tapered-off step portion 33 so as to facilitate the heat-drawing effect, thus preventing the front end of the center electrode 3 from excessively heated.

The terminal electrode 4 is integrally made of an electrically conductive material (e. g. mild steel). The terminal electrode 4 has an axial elongation 40 and an annular stopper 43 provided on a rear portion of the axial elongation 40 to be diametrically enlarged so as to engage with a rear end of the insulator 6. On a rearmost end of the annular stopper 43, a terminal portion 44 is provided to be connected to the secondary coil of the ignition coil. The axial elongation 40 has a front thread portion 41 to air-tightly engage the insulator 6 against an electrically conductive glass sealant 52.

The center electrode 3 is inserted to the front portion of the axial bore 60 with the flange portion 35 engaged with the stepped seat 66. Into the axial bore 60, the electrically conductive glass sealant 52, the monolithic resistor powder 51 and the electrically conductive glass sealant 52 are in turn loaded. After inserting the terminal electrode 4, these elements are heated to integrally encapsulate the electrically conductive glass sealant 52, 52, the monolithic resistor powder 51 and terminal electrode 4 within the axial bore 60. A talc powder 7 is air-tightly provided between the insulator 6 and the metal shell 8.

The insulator 6 is made of a sintered ceramic body with alumina ($Al_2O_3$) as a main constituent. As an alternative, the insulator 6 is made by sintering aluminum nitride (AlN) with an addition of sintering aids. The axial bore 60 extends in a longitudinal direction from a rear open end to a front open end of the insulator 6.

The insulator 6, thus far described, has a corrugated bar portion 61 which covers the axial elongation 40 inserted to the rear portion of the insulator 6. The insulator 6 further has a leg portion 62 which covers a front end portion of the center electrode 3, and exposed to the air-fuel mixture gas within the combustion chamber of the internal combustion engine. The insulator 6 still has a diametrically enlarged body stopper 67 between the corrugated bar portion 61 and the leg portion 62 to secure the insulator 6 to the metal shell 8.

The corrugated bar portion 61 defines multi-stepped surface to heighten the flashover voltage. The insulator 6 is firmly supported within the metal shell 8 by engaging a stepped portion 68 of the insulator 6 with a shoulder portion 84 of the metal shell 8 and caulking a rear end 85 of the metal shell 8 against the insulator 6 by way of the talc powder 7.

In so doing, a boundary 36 is provided between the columnar portion 30 of the center electrode 3 and the tapered-off step section 33, and the boundary 36 is located into a front end surface 63 of the leg portion 62 by e.g., 0.2 mm–0.3 mm as shown in FIG. 2. A front end surface 39 of the step section 33 is positioned outside of the front end surface 63 of the insulator 6. Between a front end 37 of the center electrode 3 and a front end 21 of the ground electrode 2, the spark gap (G) is provided. A distance (S) between the front end surface 63 of the leg portion 62 and the front end 37 of the center electrode 3 measures 2.0 mm. The distance (S) corresponds to that shown in FIG. 3.

As understood from the foregoing description, the boundary 36 of the step section 33 is located into the front end surface 63 of the insulator 6.

The structure is such that a longer stroke distance is presented to induce the flashover, thus needing a higher voltage to invite the flashover so as to render it difficult to emerge the flashover. Namely, this makes it possible to always maintain a potential voltage betweeen the boundary 36 of the tapered-off step section 33 and the stepped portion 68 of the insulator higher that a potential voltage across the spark gap (G). This leads to normally inducing the spark discharges across the spark gap (G) when a high voltage is applied across the electrodes 2, 3 at the time of ignition. By way of illustration, it is possible to decrease by 2 kV in terms of the flashover voltage according to the first embodiment of the present invention.

Figure 3A:
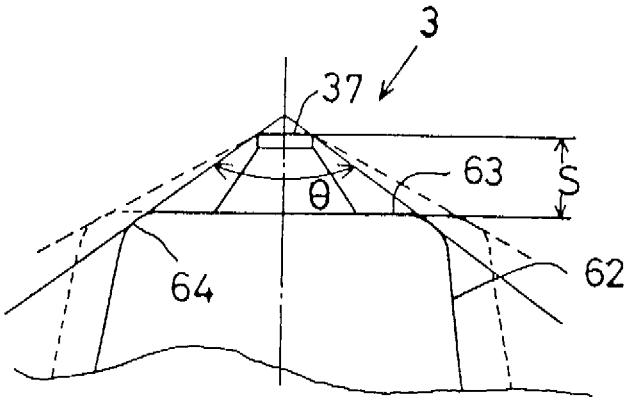
FIG. 3*a* is an enlarged plan view of a firing portion of a spark plug according to a second embodiment of the invention.
Figure 3B:
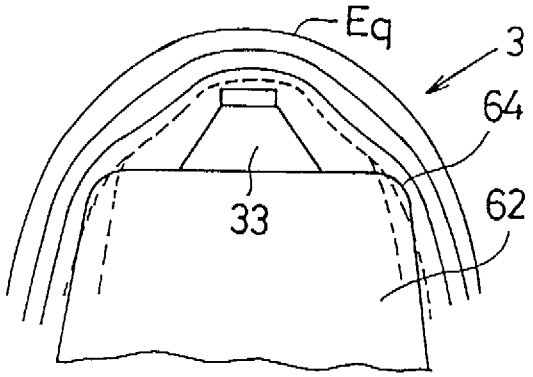
FIG. 3*b* is an enlarged plan view of the firing portion of the spark plug depicted to describe how a distribution of equi-potential curves is exhibited near a front end surface of an insulator.
Figure 4:
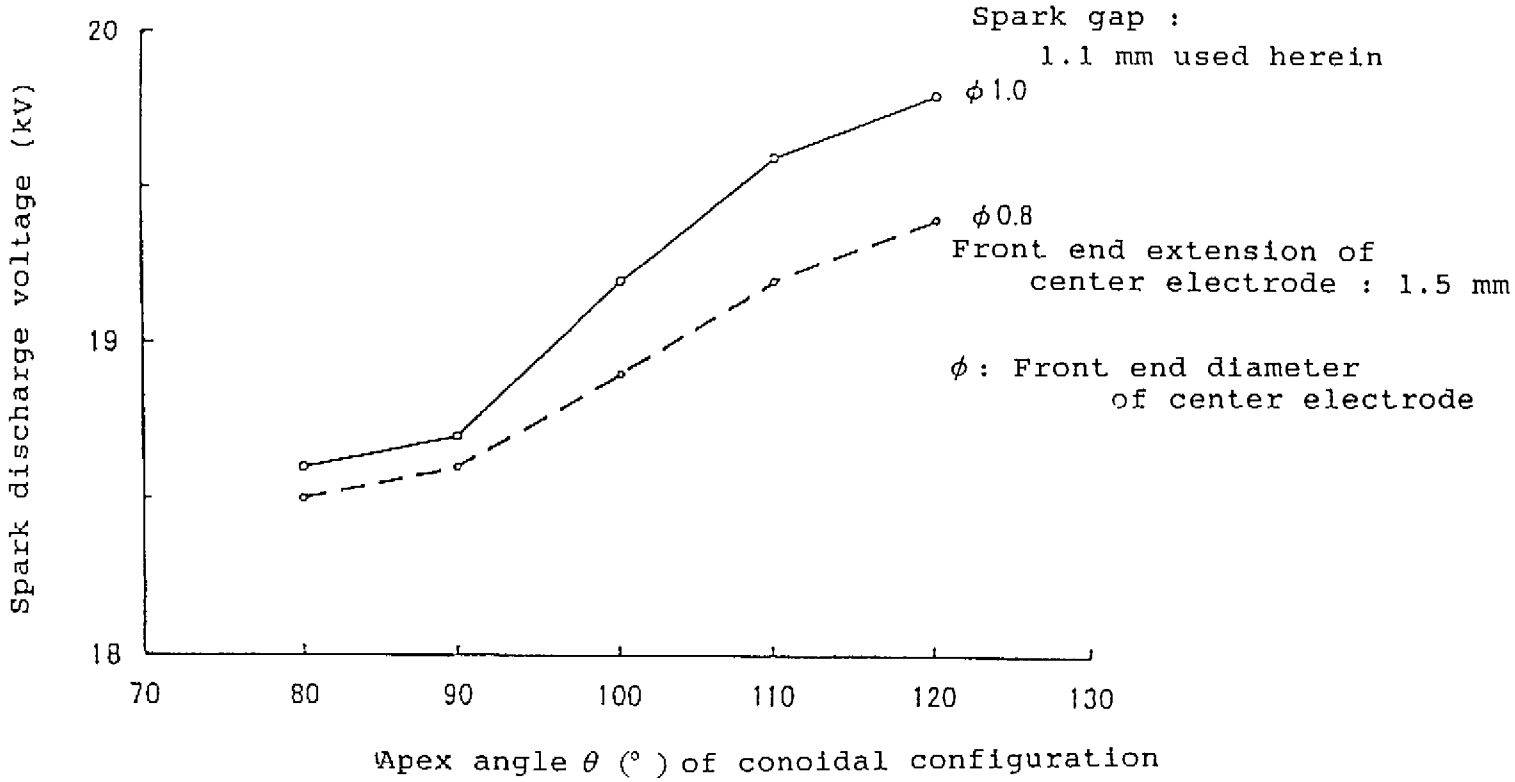
FIG. 4 is a graphical representation depicted to show a relationship between a required spark voltage (kV) and an apex angle (θ) of an imaginary conoidal configuration.
Figure 5:
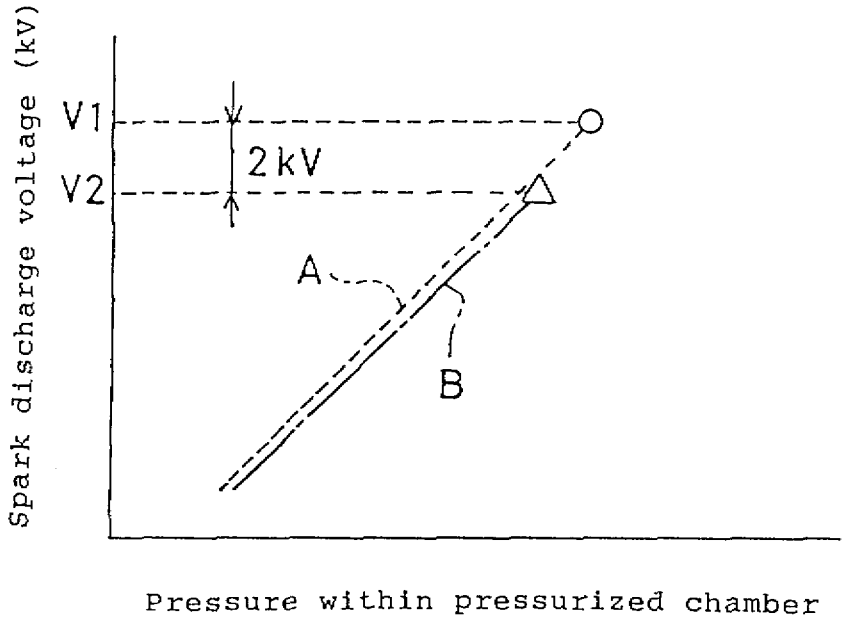
FIG. 5 is a graphical representation depicted to show a relationship between a required spark voltage and a pressure within a pressure chamber.

FIGS. 3, 4 and 5 show a second embodiment of the invention which differs from the first embodiment in the following points.

The distance (S) between the front end surface 63 of the insulator 6 and the front end 37 of the center electrode 3 measures 2.0 mm exclusive. In this instance, the distance (S) preferably measures 1.5 mm. As shown in FIG. 3*a*, a front end periphery 37 of the center electrode 3 forms an imaginary conoidal configuration which inscribes an outer periphery 64 of the insulator 6. An apex angle (θ) of the imaginary conoidal configuration forms into less than 110 degrees, preferably less than 100 degrees.

For the purpose of convenience, it is noted that the apex angle (θ) of the conoidal configuration is taken as a topmost angle of a triangle when the conoidal configuration is longitudinally sectioned along a plane containing a central axis thereof.

FIG. 4 shows a characteristic curve between a required discharge voltage and the apex angle (θ).

A relationship between the required discharge voltage and a pressure in a pressurized chamber is described as follows:

In the spark plug (A) of FIG. 5 in which the distance (S) of the center electrode 3 is 2.0 mm, and the boundary 36 of the tapered-off step section 33 is located into the front end surface 63 of the insulator 6 by 0.2 mm while determining a width of the spark gap (G) to be 1.1 mm, it is possible to heighten the voltage required to induce the flashover against the outer periphery 64 of the insulator 6 from the same reason as described at the first embodiment of the invention. In this instance, it is possible to decrease by 2 kV in terms of the flashover voltage (V1) compared to the flashover voltage (V2) of the spark plug (B) in which the boundary 36 of the tapered-off step section 33 is positioned outside of the front end surface 63 of the insulator 6 by 0.2 mm.

Additionally, the apex angle (θ) of the imaginary conoidal configuration which inscribes the outer periphery 64 of the insulator 6 forms into less than 110 degrees. This exhibits the equi-potential curves (Eq) which is coarse in density and not so widely spread outward as shown in FIG. 3*b*, as opposed to the case in which the front end surface 63 of the insulator 6 has a greater diametrical dimension. For this reason, it is possible to normally induce the spark discharges across the spark gap (G) when the high vlotage is applied across the electrodes 2, 3 at the time of ignition. This makes it possible to effectively avoid the flashover spreading back behind the front end surface 63 of the insulator 6.

In particular, it is possible to operate the spark plug without inviting the flashover even when a higher voltage is required to induce the spark discharges across the electrodes. For this reason, the spark plug can be operated in a highly pressurized combustion chamber which requires a high discharge voltage.

Figure 6:
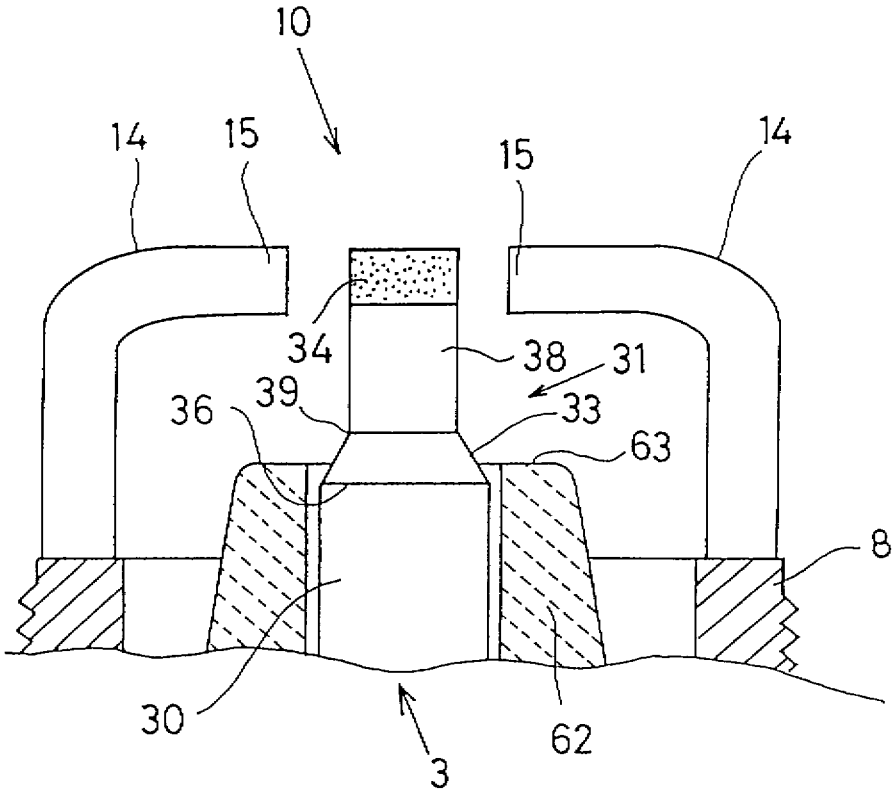
FIG. 6 is an enlarged plan view of a firing portion of a spark plug according to a third embodiment of the invention.
Figure 7:
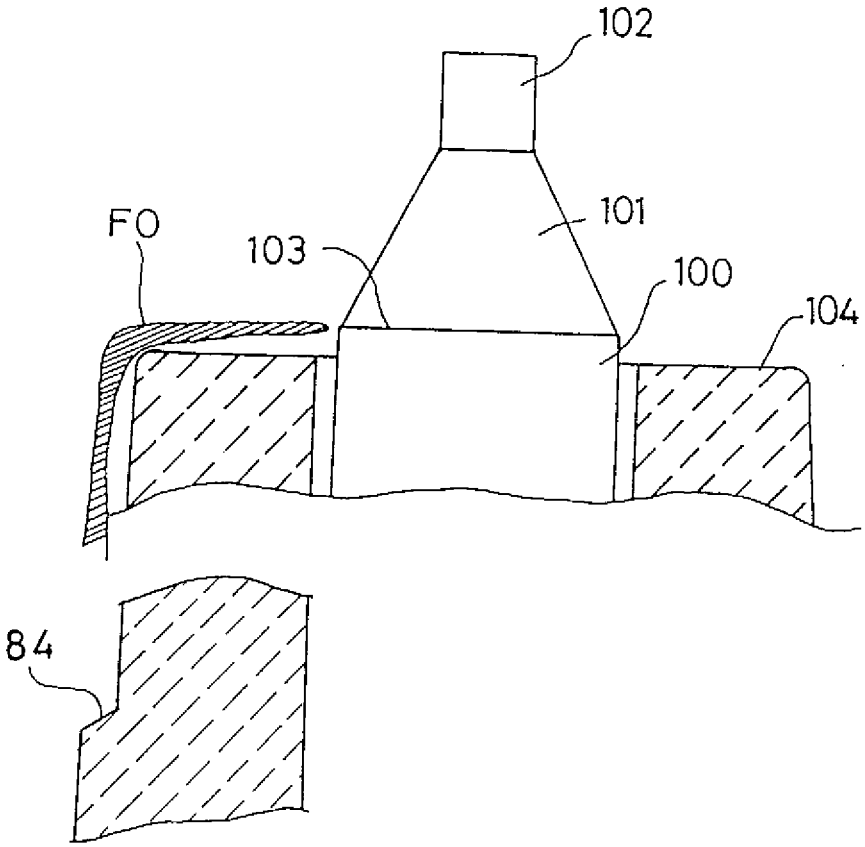
FIG. 7 is an enlarged plan view of a front portion of a center electrode and an insulator according to a prior art spark plug.

FIG. 6 shows a third embodiment of the invention which differs from the first embodiment in the following points.

The third embodiment of the invention is represented by a multi-gap type spark plug 10. The front end of the center electrode 3 has the tapered-off step portion 33 substantially formed into a frusto-cone shaped configuration. On the front end surface 39 of the tapered-off step section 33, the small columnar portion 38 is provided whose diameter is identical to that of the front end surface 39 of the tapered-off step section 33. On the front end of the metal shell 8, a plurality of ground electrodes 14, 14 are provided whose front ends 15, 15 are in registration with a front end surface side of the small columnar portion 38. To the front end surface of the small columnar portion 38, a discal noble metal tip 34 is bonded by means of laser beam welding or plastic working as the same manner as described in the first embodiment of the invention. The front end surface 39 of the tapered-off step portion 33 is positioned outside of the front end surface 63 of the insulator 6, and the boundary 36 of the tapered-off step portion 33 is located into the front end surface 63 of insulator 6.

In this instance, the geometrical relationship of FIG. 3*a* may be introduced between the imaginary conoidal configuration and the apex angle (θ).

This type of the spark plug is particularly useful for an internal combustion engine equipped with a distributorless ignition device. It is possible to operate the spark plug without inviting the flashover even when the the required discharge voltage is heightened. For this reason, the spark plug can be operated in a highly pressurized combustion chamber which requires a high discharge voltage.

It is to be observed that the circumferential boundary 36 between the step section 33 and the columnar portion 30 may be rounded by 0.1 mm or more in terms of a radius of curvature (R). With the boundary 36 thus rounded, it is possible to heighten the flashover voltage which causes the flashover.

According to the present invention, it is possible to step up increase the flashover voltage to such a degree as to enable the spark plug to normally induce the spark discharges across the electrodes in the air-fuel mixtutre so as to ameliorate the ignitability. For this reason, the present invention is particularly useful for a gas engine which requires a high discharge voltage due to a high compression ratio because it employs gaseous fuel such as natural gas, synthetic gas, LPG or the like.

While the invention has been described with reference to the specific embodiments, it is understood that this description is not to be construed in a limitting sense in as much as various modifications and additions to the specific embodiments may be made by skilled artisans without departing the scope of the invention.

What is claimed is:

1. A spark plug comprising an elongated insulator in which a center electrode is supported, a cylindrical metal shell in which the insulator is supported, and a ground electrode extending from the metal shell to form a spark gap with a front end of the center electrode, so that only one spark gap is formed:

the spark plug comprising:

the front end of the center electrode having a tapered-off step section whose front end surface has a spark erosion resistant portion, and having a boundary between a columnar portion of the center electrode and the tapered-off step section;

the boundary of the tapered-off step section being located into a front end surface of the insulator, and a front end surface of the tapered-off step section being positioned outside of the front end surface of the insulator in order to prevent a flashover from forming behind the front end surface of the insulator and;

wherein a conoidal configuration is formed, having an apex located coaxially with the front end of the center electrode and circumscribing a front periphery of the insulator while maintaining an apex angle of 110 degrees or less.

2. A spark plug as recited in claim 1, wherein a noble metal tip is provided on a small columnar portion of the center electrode as the spark erosion resistant portion to be aligned with a front end of the ground electrode.

3. A spark plug as recited in claim 2, wherein the noble metal tip is at least one selected from the group consisting of Pt, Ir, Pt-based alloy, Ir-based alloy and an oxide of these metals containing an oxide such as $Y_2O_3$ or the like.

4. A multi-gap type spark plug comprising an elongated insulator in which a center electrode is supported, a cylindrical metal shell in which the insulator is supported, and a plurality of ground electrodes extended from the metal shell to form spark gaps with a front end of the center electrode, the spark plug comprising:

the front end of the center electrode having a tapered-off step section including a small columnar portion whose diameter is same as that of a front end surface of the tapered-off step section on which the small columnar portion is provided, and having a boundary between the small columnar portion of the center electrode and the tapered-off step section;

a front end of each of the ground electrodes being aligned with a front end of the small columnar portion; and the boundary of the tapered-off step section being located within a front end surface of the insulator, and a front end surface of the tapered-off step section being positioned outside of the front end surface of the insulator, wherein a conoidal configuration is formed, having an apex angle formed at the front end of the center electrode, and circumscribing a front periphery of the insulator while maintaining an apex angle of 110 degrees or less.

5. A spark plug as recited in claim 3, wherein a noble metal tip is provided on the small columnar portion of the center electrode as an spark erosion resistant portion to be in registration with a front end portion of the ground electrodes.

* * * * *